US009938761B2

(12) United States Patent
Siddiqui et al.

(10) Patent No.: US 9,938,761 B2
(45) Date of Patent: Apr. 10, 2018

(54) THERMALLY-BROKEN ORNAMENTAL DOOR

(71) Applicants: Aneel Nadeem Siddiqui, Collierville, TN (US); Ahmed Nadim Siddiqui, Collierville, TN (US); Imran Ahmed Siddiqui, Collierville, TN (US)

(72) Inventors: Aneel Nadeem Siddiqui, Collierville, TN (US); Ahmed Nadim Siddiqui, Collierville, TN (US); Imran Ahmed Siddiqui, Collierville, TN (US)

( * ) Notice: Subject to any disclaimer, the term of this patent is extended or adjusted under 35 U.S.C. 154(b) by 0 days.

(21) Appl. No.: 15/265,393

(22) Filed: Sep. 14, 2016

(65) Prior Publication Data

US 2017/0218681 A1 Aug. 3, 2017

Related U.S. Application Data

(60) Provisional application No. 62/289,483, filed on Feb. 1, 2016.

(51) Int. Cl.

| | |
|---|---|
| ***E06B 3/70*** | (2006.01) |
| ***E06B 1/32*** | (2006.01) |
| ***E06B 1/18*** | (2006.01) |
| ***E06B 1/52*** | (2006.01) |
| ***E06B 3/263*** | (2006.01) |
| ***E06B 3/54*** | (2006.01) |
| ***E06B 1/70*** | (2006.01) |

(52) U.S. Cl.

CPC ..... *E06B 1/325* (2013.01); *E06B 1/18* (2013.01); *E06B 1/52* (2013.01); *E06B 1/70* (2013.01); *E06B 3/26305* (2013.01); *E06B 3/54* (2013.01); *E06B 3/7015* (2013.01); *E06B 2001/707* (2013.01); *E06B 2003/7023* (2013.01)

(58) Field of Classification Search

CPC ... E06B 1/325; E06B 1/18; E06B 1/52; E06B 3/26305; E06B 3/7015; E06B 1/70; E06B 3/54; E06B 2001/707; E06B 2003/7023

USPC ..... 52/309.9, 455, 784.1, 794.1

See application file for complete search history.

(56) References Cited

U.S. PATENT DOCUMENTS 4,080,764 A * 3/1978 Stowik ..... E06B 1/26 52/173.1

4,411,104 A * 10/1983 St. Aubin ..... E06B 1/70 49/467

(Continued)

*Primary Examiner* — Basil Katcheves
*Assistant Examiner* — Joshua Ihezie

(57) ABSTRACT

A thermally-broken ornamental door includes a thermally-broken door and a thermally-broken jamb through which thermal transfer is greatly minimized. The thermally-broken door includes an outer panel and an inner panel that are minimally connected through a plurality of door bridging strips. The thermally-broken jamb includes an outer jamb frame and an inner jamb frame that are minimally connected through a plurality of jamb bridging strips. An insulating foam panel is present between the outer panel and the inner panel while an insulating foam core is present between the outer jamb frame and the inner jamb frame. A window assembly is hingedly mounted into the thermally-broken door and includes a retaining spacer frame that minimizes thermal transfer from an exterior environment to an inner window frame through a glass panel of the window assembly. The retaining spacer frame additionally provides structural support to the glass panel.

9 Claims, 11 Drawing Sheets

(56) References Cited

U.S. PATENT DOCUMENTS 4,594,831 A * 6/1986 Winyard ..... E06B 1/045 49/DIG. 1
4,631,866 A * 12/1986 Otto ..... E06B 1/32 292/341.19
4,716,700 A * 1/1988 Hagemeyer ..... E06B 3/7001 52/313
4,811,538 A * 3/1989 Lehnert ..... E06B 5/16 428/70
4,930,257 A * 6/1990 Windgassen ..... E06B 1/325 49/400
5,161,329 A * 11/1992 Brown ..... F25D 23/02 49/380
5,365,706 A * 11/1994 Elsenpeter ..... E06B 7/30 292/95
5,522,195 A * 6/1996 Bargen ..... E06B 5/16 52/309.9
5,644,870 A * 7/1997 Chen ..... E06B 3/7001 49/501
5,727,349 A * 3/1998 McLaughlin ..... E06B 1/52 49/371
7,748,120 B2 * 7/2010 Turner ..... B29C 44/1233 29/428
7,832,166 B2 * 11/2010 Daniels ..... E06B 3/7015 52/232
8,381,381 B2 * 2/2013 Daniels ..... E06B 3/7015 144/346
9,441,412 B1 * 9/2016 Hooper, Jr. ..... E06B 3/263
9,470,037 B1 * 10/2016 Haynes ..... E06B 1/18
2002/0092258 A1 * 7/2002 Rochman ..... E05B 17/2084 52/630
2003/0033786 A1 * 2/2003 Yulkowski ..... E06B 5/16 52/784.15
2008/0254243 A1 * 10/2008 Turner ..... B29C 44/1233 428/34.1
2009/0044471 A1 * 2/2009 Harlin ..... B29C 70/30 52/309.13
2010/0229500 A1 * 9/2010 Lynch ..... E06B 3/5892 52/784.13
2010/0257802 A1 * 10/2010 Strickland ..... E06B 3/822 52/404.3
2015/0292841 A1 * 10/2015 Fultz ..... F41H 5/226 89/36.04
2017/0044818 A1 * 2/2017 Haynes ..... E06B 1/22

* cited by examiner

SECTION A-A

DETAIL B

THERMALLY-BROKEN ORNAMENTAL DOOR

The current application claims a priority to the U.S. Provisional Patent application Ser. No. 62/289,483 filed on Feb. 1, 2016.

FIELD OF THE INVENTION

The present invention relates generally to an ornamental door. More specifically, the present invention is a thermally-broken ornamental door that minimizes the thermal transfer between an exterior-facing portion and an interior-facing portion of the ornamental door.

BACKGROUND OF THE INVENTION

Ornamental doors are often utilized to upgrade the aesthetic appeal of a home due to their unique and aesthetically-pleasing appearance. Ornamental doors may be composed of a variety of materials. Wooden doors are favored for their strength and beauty. However, wooden doors are subject to questionable longevity due to the tendency of wood to splinter, rot, and warp over time. As a result, wooden doors require a large amount of maintenance and even then must eventually be replaced. The longevity of steel and fiberglass doors is generally greater than that of wooden doors. However, steel and fiberglass doors are not considered as beautiful as wooden doors, decreasing the overall aesthetic appeal of steel and fiberglass doors. Ornamental iron doors are favored due to a number of inherent advantages over doors composed of alternate materials such as wood, steel, and fiberglass. While ornamental iron doors are aesthetically-pleasing, the doors are not considered to be energy efficient despite the unlikeliness of leaking air or water into a building. This is due to the lack of a thermal break between the exterior environment and the interior environment as the exterior portion of the door is directly connected to the interior portion of the door. The direct connection results in a large amount of thermal transfer from the exterior environment to the interior environment through the door. Because there is no interruption of thermal transfer from the exterior environment to the interior environment, the interior portion of the door becomes cold in the winter and warm in the summer. The lack of a thermal break may additionally result in unwanted condensation forming on the door, particularly if there is high interior humidity.

The present invention is a thermally-broken ornamental door that minimizes thermal transfer between the exterior-facing portion and the interior-facing portion of the ornamental door. The exterior-facing portion and the interior-facing portion of the ornamental door are in minimal contact with each other. The minimized thermal contact between the two portions results in an ornamental door in which thermal transfer between the exterior-facing portion and the interior-facing portion is greatly reduced. Insulation is present between the exterior-facing portion and the interior-facing portion, further reducing thermal transfer. As a result, the temperature of the interior-facing portion is much closer to the ambient interior temperature.

DETAIL DESCRIPTIONS OF THE INVENTION

All illustrations of the drawings are for the purpose of describing selected versions of the present invention and are not intended to limit the scope of the present invention.

The present invention is a thermally-broken ornamental door that provides aesthetic appeal while minimizing the amount of thermal transfer between the exterior-facing portion and the interior-facing portion of the ornamental door. The present invention is shown in FIGS. 1-5 and comprises a thermally-broken door 1 and a thermally-broken jamb 10.

Figure 1:
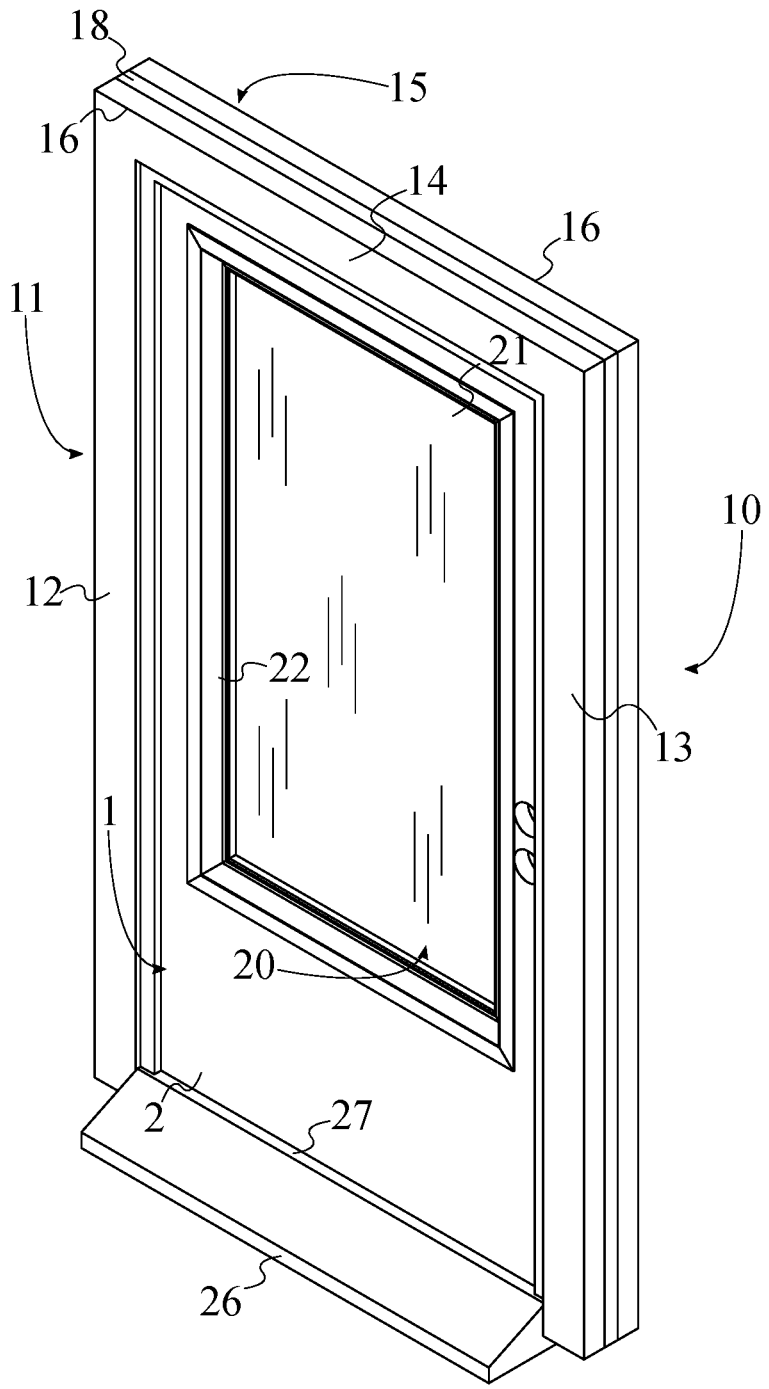
FIG. 1 is a front perspective view of the present invention.
Figure 2:
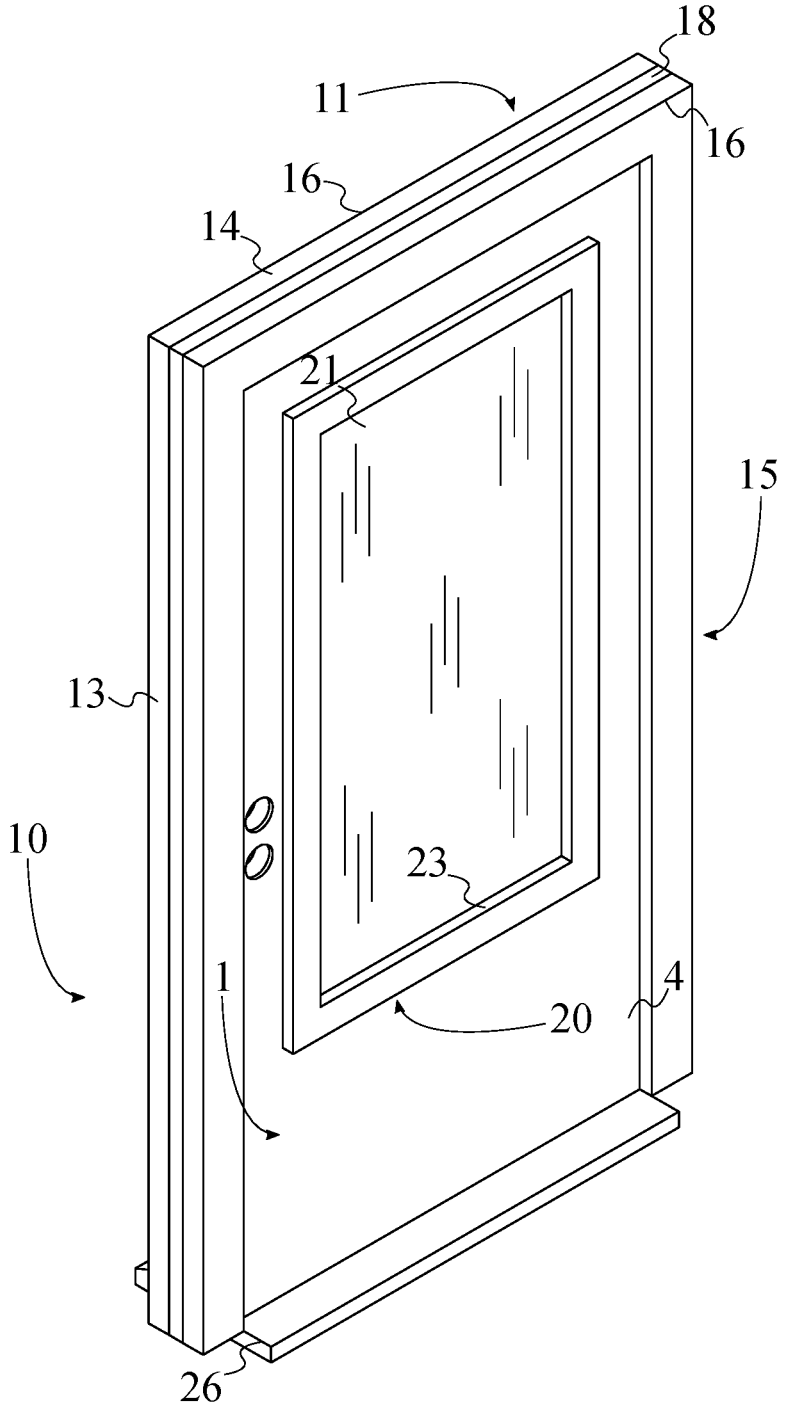
FIG. 2 is a rear perspective view of the present invention.
Figure 3:
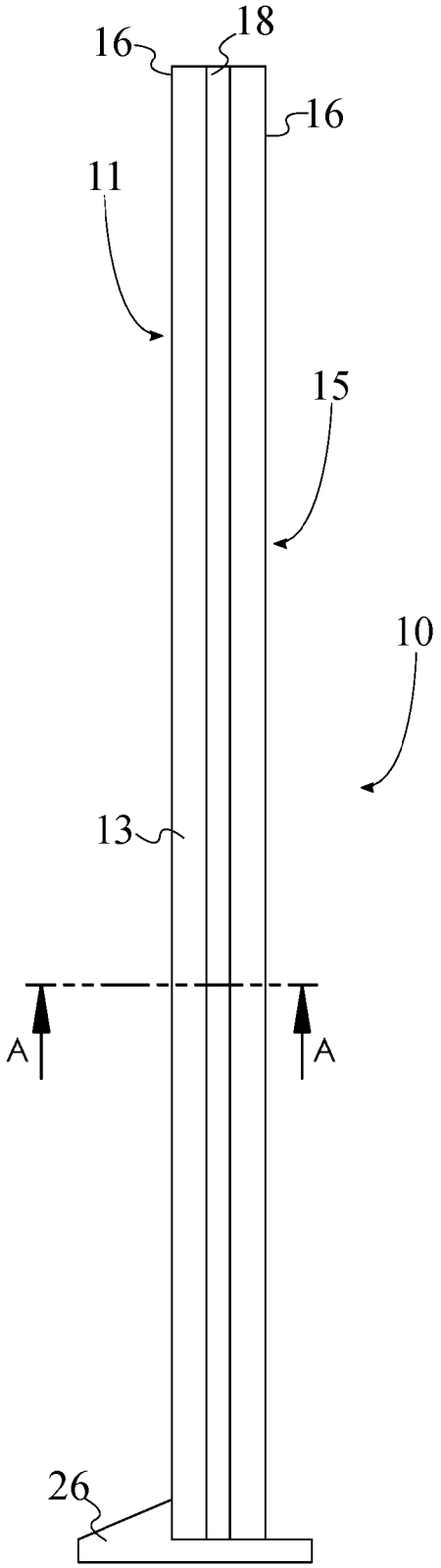
FIG. 3 is a right side view of the present invention.
Figure 4:
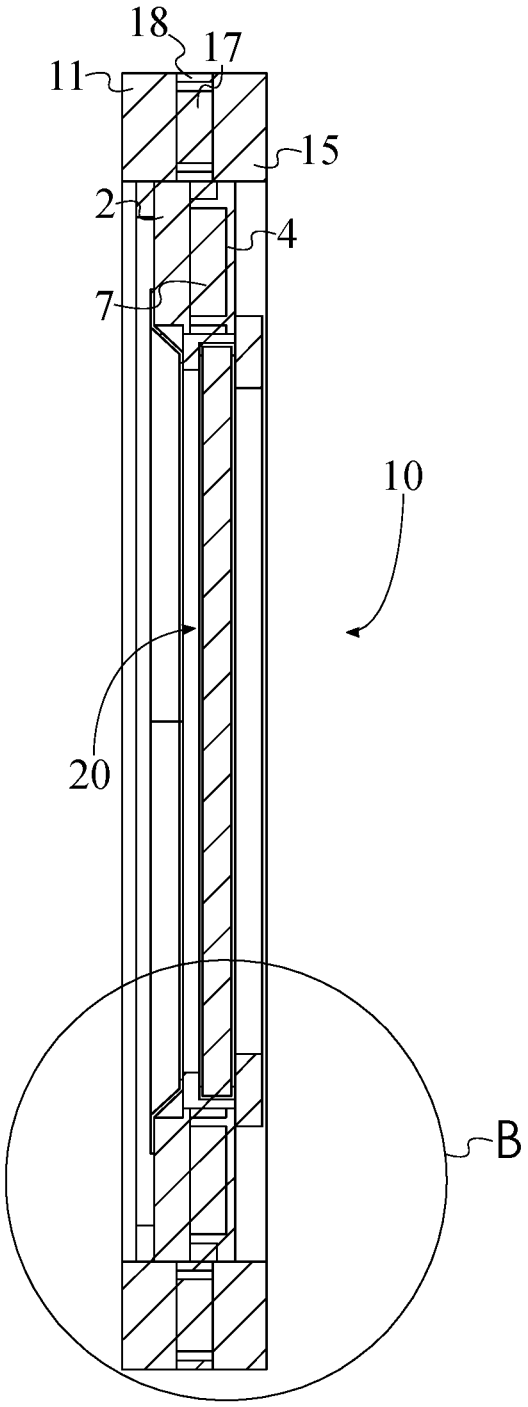
FIG. 4 is a cross-sectional view of the present invention taken along line A-A of FIG. 3.
Figure 5:
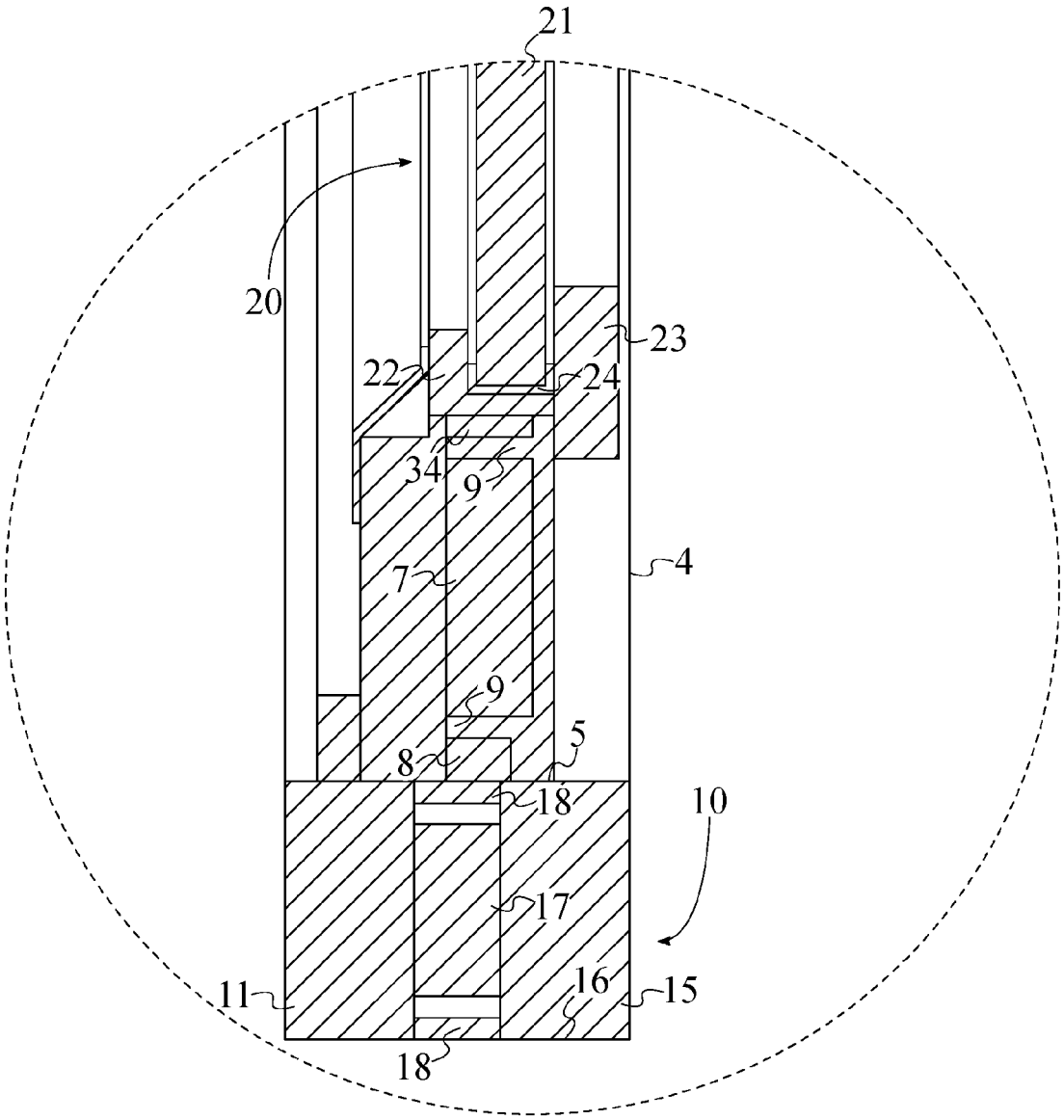
FIG. 5 is a detail view of the present invention taken from circle B of FIG. 4.
Figure 6:
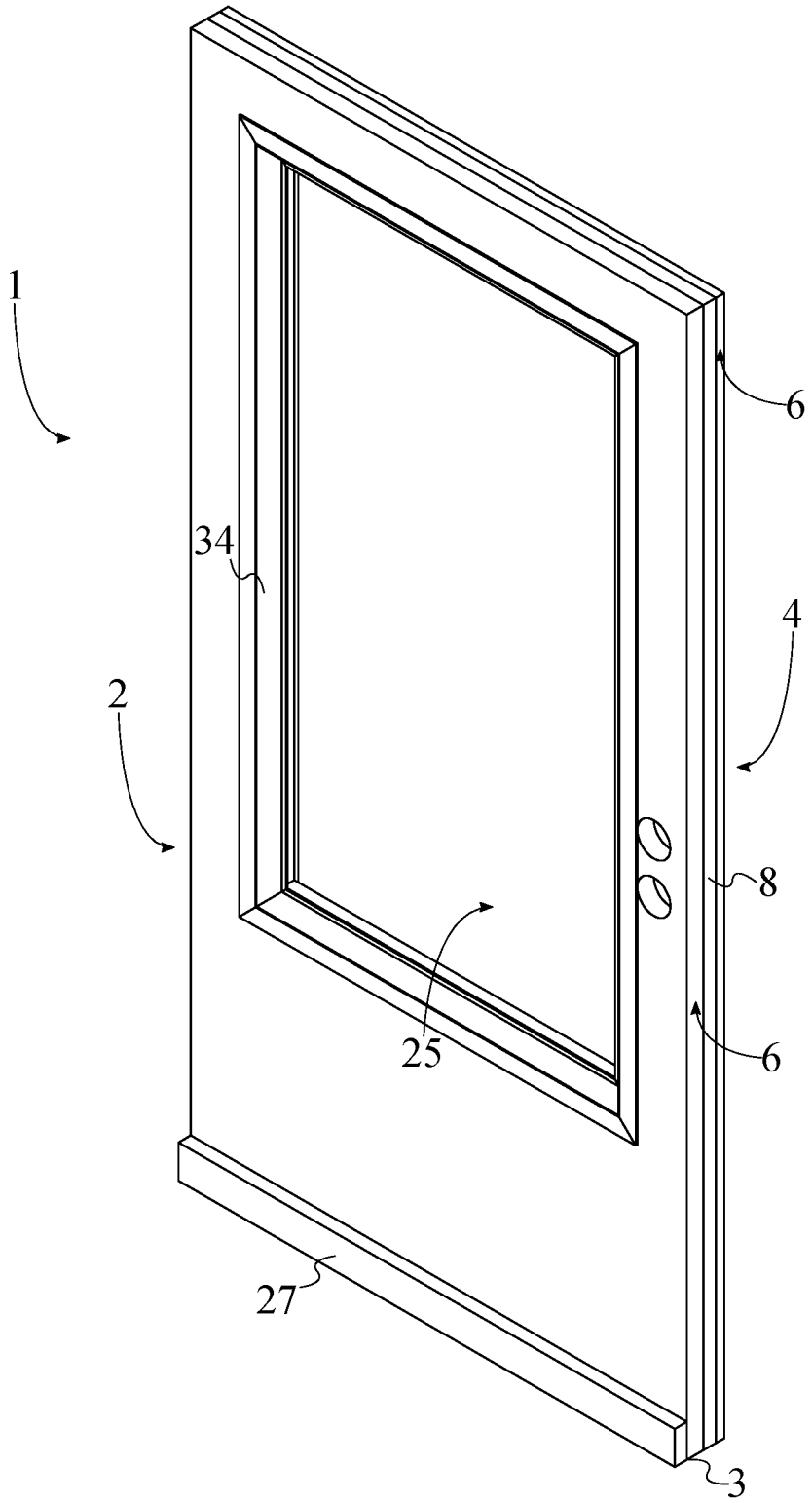
FIG. 6 is a front perspective view of the thermally-broken door.
Figure 7:
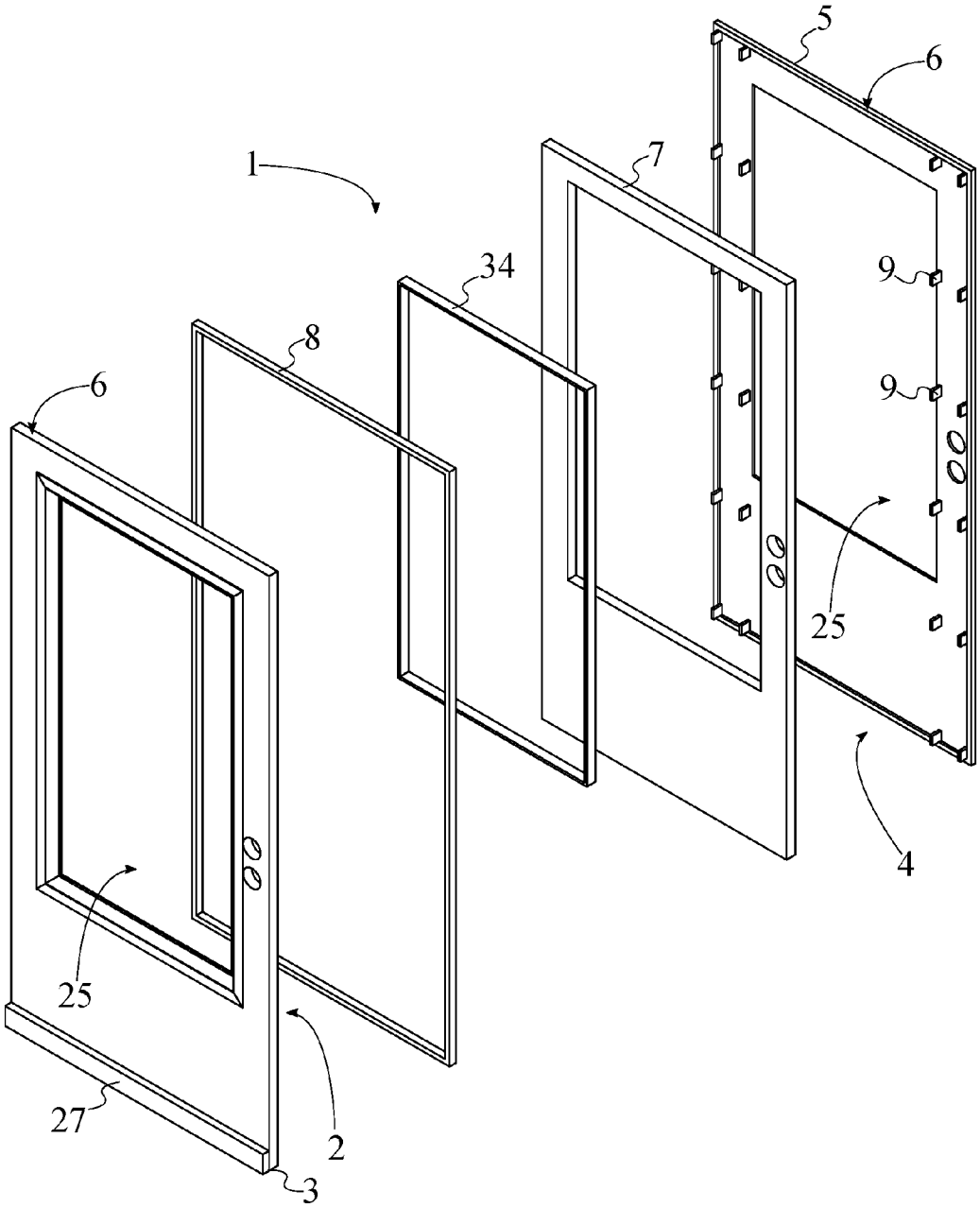
FIG. 7 is a front exploded perspective view of the thermally-broken door.

With continued reference to FIGS. 1-5 and with reference to FIG. 6 and FIG. 7, the thermally-broken door 1 is a door that is positioned into the thermally-broken jamb 10 and may be utilized in the same manner as a conventional door. The thermally-broken door 1 is designed in a manner to minimize the thermal transfer between the exterior-facing portion and the interior-facing portion of the thermally-broken door 1. The thermally-broken door 1 comprises an outer panel 2, an inner panel 4, an insulating foam panel 7, a door thermal break seal 8, and a plurality of door bridging strips 9. The outer panel 2 is the exterior-facing portion of the thermally-broken door 1 while the inner panel 4 is the interior-facing portion of the thermally-broken door 1. The insulating foam panel 7 provides thermal insulation by reducing the thermal transfer between the outer panel 2 and the inner panel 4. The plurality of door bridging strips 9 is utilized to minimally connect the outer panel 2 to the inner panel 4 rather than placing the outer panel 2 and the inner panel 4 into direct contact with each other.

The plurality of door bridging strips 9 is perimetrically distributed around a panel outer edge 5 of the inner panel 4. The plurality of door bridging strips 9 is thus offset from each other in order to provide multiple points of contact between the outer panel 2 and the inner panel 4. The outer panel 2 is mounted adjacent to the inner panel 4 by the plurality of door bridging strips 9, forming the physical structure of the thermally-broken door 1. As previously discussed, the outer panel 2 and the inner panel 4 are not in direct contact with each other. The plurality of door bridging strips 9 provides minimal contact between the outer panel 2 and the inner panel 4, thus minimizing the thermal transfer between the outer panel 2 and the inner panel 4. The insulating foam panel 7 is positioned in between the outer panel 2 and the inner panel 4 in order to further reduce the thermal transfer between the outer panel 2 and the inner panel 4. The temperature of the inner panel 4 is thus much closer to the ambient interior temperature. In the preferred embodiment of the present invention, the insulating foam panel 7 is closed-cell polyurethane foam.

The door thermal break seal 8 serves to seal the gap between the outer panel 2 and the inner panel 4 that is formed due to the plurality of door bridging strips 9 that is utilized to connect the outer panel 2 to the inner panel 4. The door thermal break seal 8 is hermetically connected in between the outer panel 2 and the inner panel 4, preventing air and water from leaking into the gap between the outer panel 2 and the inner panel 4. The door thermal break seal 8 is positioned about the insulating foam panel 7. This ensures that the door thermal break seal 8 is able to thoroughly seal the gap between the edges of the outer panel 2 and the inner panel 4, preventing exterior elements from leaking in between the outer panel 2 and the inner panel 4. In the preferred embodiment of the present invention, the door thermal break seal 8 traverses along the plurality of door bridging strips 9 from an outer lateral surface 6 of the inner panel 4 to an outer lateral surface 6 of the outer panel 2, fully sealing the gap between the outer panel 2 and the inner panel 4. The door thermal break seal 8 additionally features insulating properties to minimize thermal transfer between the outer panel 2 and the inner panel 4.

Figure 8:
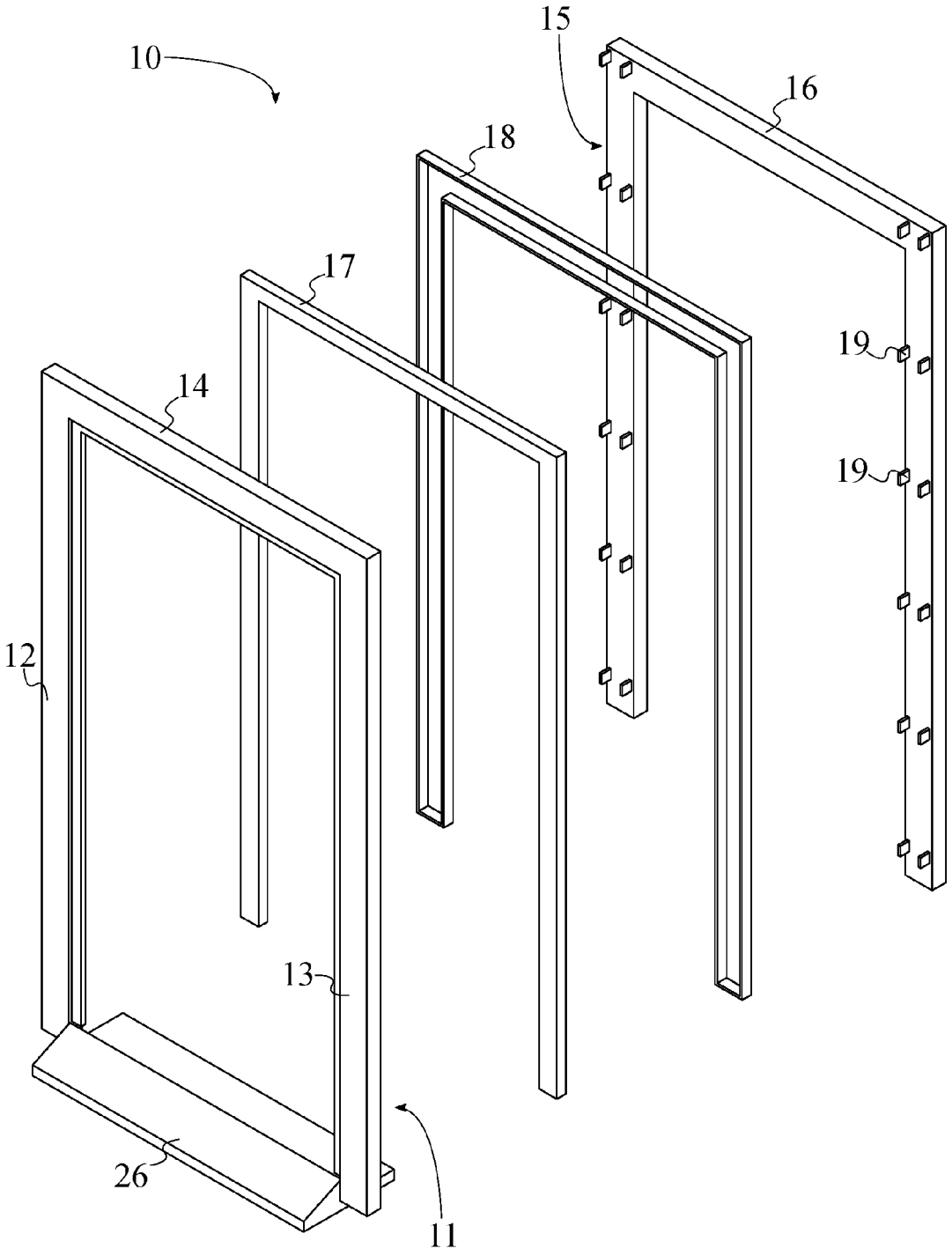
FIG. 8 is a front exploded perspective view of the thermally-broken jamb.

Again with reference to FIGS. 1-5 and with reference to FIG. 8, the thermally-broken jamb 10 serves as a doorframe for the thermally-broken door 1 and may be installed into an opening in a wall, much like a conventional doorframe. Similar to the thermally-broken door 1, the thermally-broken jamb 10 is designed in a manner to minimize the thermal transfer between the exterior-facing portion and the interior-facing portion of the thermally-broken jamb 10. The thermally-broken door 1 is hingedly mounted into the thermally-broken jamb 10, enabling the thermally-broken door 1 to be opened and closed within the thermally-broken jamb 10 as needed. The thermally-broken jamb 10 comprises an outer jamb frame 11, an inner jamb frame 15, an insulating foam core 17, a jamb thermal break seal 18, and a plurality of jamb bridging strips 19. The outer jamb frame 11 is the exterior-facing portion of the thermally-broken jamb 10 while the inner jamb frame 15 is the interior-facing portion of the thermally-broken jamb 10. The outer jamb frame 11 includes a door stop for the thermally-broken door 1 when the thermally-broken door 1 is positioned within the thermally-broken jamb 10. The insulating foam core 17 reduces thermal transfer between the outer jamb frame 11 and the inner jamb frame 15. Finally, the plurality of jamb bridging strips 19 minimally connects the outer jamb frame 11 to the inner jamb frame 15 rather than placing the outer jamb frame 11 and the inner jamb frame 15 into direct contact with each other.

The plurality of jamb bridging strips 19 is perimetrically distributed around a frame outer edge 16 of the inner jamb frame 15. Much like the plurality of door bridging strips 9, the plurality of jamb bridging strips 19 is offset from each other and provides multiple points of contact between the outer jamb frame 11 and the inner jamb frame 15. As with the outer panel 2 and the inner panel 4, the outer jamb frame 11 and the inner jamb frame 15 are not placed into direct contact with each other. The outer jamb frame 11 is mounted adjacent to the inner jamb frame 15 by the plurality of jamb bridging strips 19, forming the physical structure of the thermally-broken jamb 10. The plurality of jamb bridging strips 19 provides minimal contact between the outer jamb frame 11 and the inner jamb frame 15 and thus minimizes the thermal transfer between the outer jamb frame 11 and the inner jamb frame 15. The insulating foam core 17 is positioned in between the outer jamb frame 11 and the inner jamb frame 15 in order to further minimize thermal transfer between the outer jamb frame 11 and the inner jamb frame 15. In the preferred embodiment of the present invention, the insulating foam core 17 is closed-cell polyurethane foam, much like the insulating foam panel 7.

The jamb thermal break seal 18 functions much like the door thermal break seal 8 and seals the gap between the outer jamb frame 11 and the inner jamb frame 15 formed by the plurality of jamb bridging strips 19 utilized to connect the outer jamb frame 11 to the inner jamb frame 15. The jamb thermal break seal 18 is hermetically connected in between the outer jamb frame 11 and the inner jamb frame 15 in order to prevent air and water from leaking into the gap between the outer jamb frame 11 and the inner jamb frame 15. The jamb thermal break seal 18 is positioned about the insulating foam core 17, ensuring that the gap between the outer jamb frame 11 and the inner jamb frame 15 is fully sealed. The jamb thermal break seal 18 includes insulating properties to minimize thermal transfer between the outer jamb frame 11 and the inner jamb frame 15.

Figure 9:
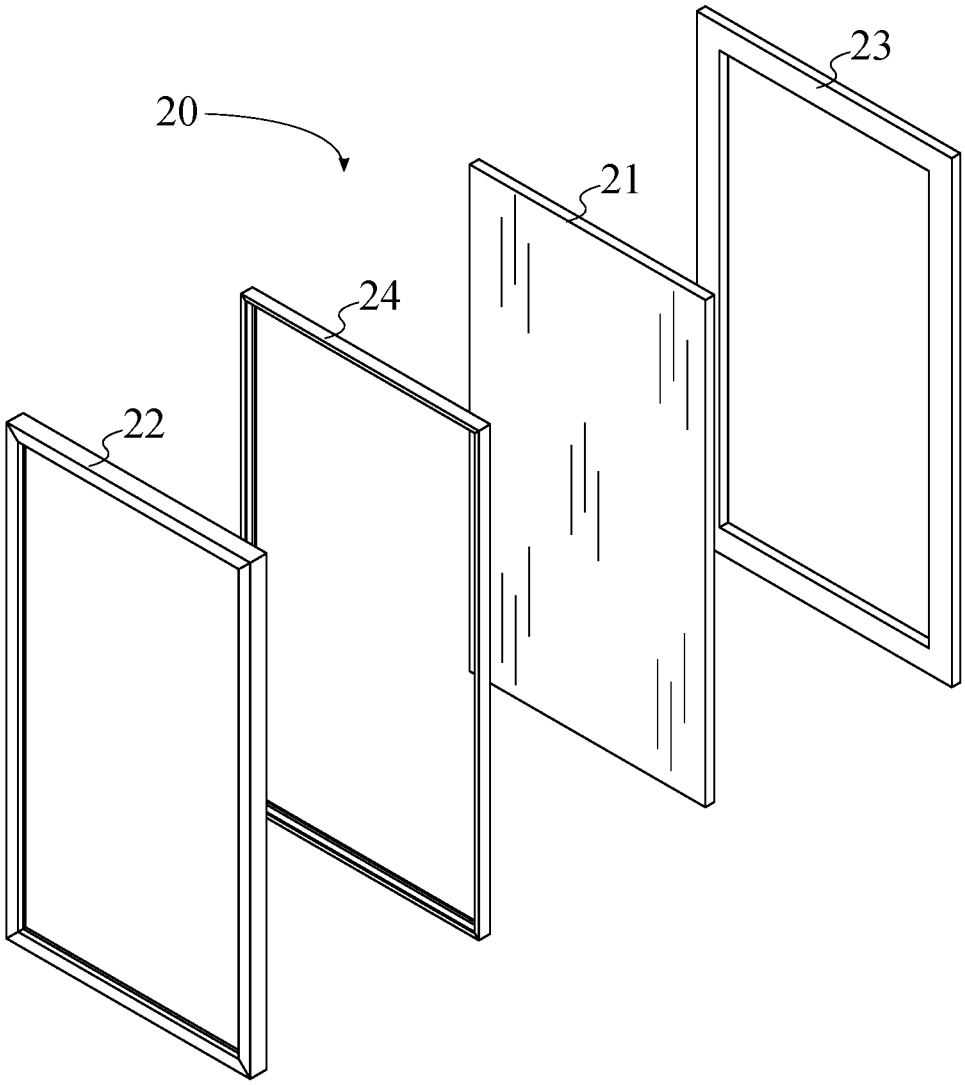
FIG. 9 is a front exploded perspective view of the window assembly.

Again with reference to FIGS. 1-5 and with reference to FIG. 9, the present invention further comprises a window assembly 20 and a window opening 25. The window assembly 20 provides visibility through the present invention and is positioned within the window opening 25. The window opening 25 is an opening on the thermally-broken door 1 that accommodates the window assembly 20. The window opening 25 traverses normally through the outer panel 2, the inner panel 4, and the insulating foam panel 7. In the preferred embodiment of the present invention, the outer panel 2 features an ornamental design adjacent to the window opening 25. The window assembly 20 may thus be seated within the outer panel 2, the inner panel 4, and the insulating foam panel 7. The window assembly 20 is positioned within the window opening 25, ensuring that the window assembly 20 is able to cover and seal the window opening 25. In the preferred embodiment of the present invention, the window assembly 20 is hingedly mounted to the inner panel 4, enabling the window assembly 20 to be opened and closed within the window opening 25 as needed.

The present invention further comprises a window opening thermal break seal 34 while the window assembly 20 comprises a glass panel 21, a retaining spacer frame 22, an inner window frame 23, and a window weather seal 24. The window opening thermal break seal 34 is utilized to seal the gap between the outer panel 2 and the inner panel 4 adjacent to the window opening 25 due to the plurality of door bridging strips 9 that is utilized to connect the outer panel 2 to the inner panel 4. The glass panel 21 is a clear, partially opaque, or fully opaque glass that provides aesthetic appeal to the window assembly 20. The retaining spacer frame 22 is utilized to hold and support the glass panel 21. The retaining spacer frame 22 additionally provides insulation for the window assembly 20 by minimizing thermal transfer between the exterior environment, the glass panel 21, and the inner window frame 23. The inner window frame 23 is the interior-facing portion of the window assembly 20. The window weather seal 24 is utilized to prevent exterior elements from leaking or otherwise passing through the window assembly 20. The window opening thermal break seal 34 further serves to minimize thermal transfer through the window assembly 20.

The window weather seal 24 is perimetrically connected around the glass panel 21, enabling the window weather seal 24 to prevent leakage along the entire perimeter of the glass panel 21. In the preferred embodiment of the present invention, the window weather seal 24 is in contact with both the exterior-facing face and the interior-facing face of the glass panel 21. The retaining spacer frame 22 is perimetrically connected around the window weather seal 24 and is preferably composed of a thermally non-conductive material. The retaining spacer frame 22 is thus able to provide structural support to the glass panel 21 and ensure that the glass panel 21 remains upright and in place. The positioning of the retaining spacer frame 22 additionally provides insulation for the glass panel 21 and reduces thermal transfer from the exterior environment to the inner window frame 23 through the glass panel 21. The retaining spacer frame 22 is hermetically pressed against the window weather seal 24, preventing any leakage or other transfer of elements between the window weather seal 24 and the retaining spacer frame 22. The window weather seal 24 is hermetically pressed against the glass panel 21 in order to ensure that the window weather seal 24 remains fixed in place on the glass panel 21 and to prevent separation. Additionally, the inner window frame 23 is hermetically pressed against the window weather seal 24, allowing the window weather seal 24 to seal the gaps between the inner window frame 23, the retaining spacer frame 22, and the glass panel 21. The inner window frame 23 is hermetically pressed against the retaining spacer frame 22, further minimizing leakage through the window assembly 20. Because the retaining spacer frame 22 is preferably composed of thermally non-conductive material, the thermal transfer from the exterior environment to the interior environment through the window assembly 20 is minimized. The window opening thermal break seal 34 is hermetically connected in between the outer panel 2 and the inner panel 4, sealing the gap between the outer panel 2 and the inner panel 4 adjacent to the window opening 25 and preventing air and water from leaking into the gap between the outer panel 2 and the inner panel 4. The window opening thermal break seal 34 is positioned about the window opening 25 and is thus positioned around the entire perimeter of the window opening 25 in order to minimize thermal transfer through the window assembly 20. The window opening thermal break seal 34 additionally features insulating properties to minimize thermal transfer between the outer panel 2 and the inner panel 4.

When the window assembly 20 is in a closed configuration within the window opening 25, the gap between the window assembly 20 and the thermally-broken door 1 is sealed in order to prevent the passage of exterior elements through the gap. The gap is preferably sealed by an additional weather seal that extends around the perimeter of the window opening 25 on the thermally-broken door 1 and is placed into contact with the window assembly 20 when the window assembly 20 is in a closed configuration. A stopper plate or similar structure may be utilized as a stop for the window assembly 20 within the window opening 25.

The present invention further comprises a thermally-insulative threshold 26. The thermally-insulative threshold 26 is preferably angled and additionally prevents water from leaking through the thermally-broken door 1. The outer jamb frame 11 comprises a first elongated member 12, a second elongated member 13, and a cross member 14 that form the structure of the outer jamb frame 11. The first elongated member 12 and the second elongated member 13 are oriented parallel to each other and form the vertically-oriented portions of the outer jamb frame 11. The cross member 14 joins the first elongated member 12 to the second elongated member 13 and is connected across the first elongated member 12 and the second elongated member 13. The cross member 14 thus forms the horizontally-oriented portion of the outer jamb frame 11. The thermally-insulative threshold 26 is connected across the first elongated member 12 and the second elongated member 13 and is thus positioned to seal the thermally-broken door 1 and the thermally-broken jamb 10 to prevent water from passing through and into a building. The cross member 14 and the thermally-insulative threshold 26 are positioned opposite to each other along the first elongated member 12 and the second elongated member 13. In the preferred embodiment of the present invention, the cross member 14 is positioned at a top end of the first elongated member 12 and the second elongated member 13 while the thermally-insulative threshold 26 is positioned at a bottom end of the first elongated member 12 and the second elongated member 13. The thermally-insulative threshold 26 is thus able to prevent water from passing through the bottom of the thermally-broken door 1 and the thermally-broken jamb 10.

The present invention further comprises a door sweep 27 that is able to engage with the thermally-insulative threshold 26 in order to seal the gap between the thermally-insulative threshold 26 and the thermally-broken door 1 when the thermally-broken door 1 is closed. In the preferred embodiment of the present invention, the door sweep 27 is insulative and minimizes thermal transfer between the exterior environment and the interior environment when the present invention is in use. The door sweep 27 is connected along a base edge 3 of the outer panel 2, enabling the door sweep 27 to engage with the thermally-insulative threshold 26 when the thermally-broken door 1 is closed. The thermally-broken door 1 and the thermally-broken jamb 10 are shown in a closed configuration in FIGS. 1-5. In the closed configuration, the door sweep 27 is positioned adjacent to the thermally-insulative threshold 26, sealing the gap between the thermally-broken door 1 and the thermally-insulative threshold 26.

As previously discussed, the thermally-broken door 1 is hingedly mounted into the thermally-broken jamb 10 while the window assembly 20 is hingedly mounted to the inner panel 4. The aforementioned hinged connections may be accomplished utilizing common hinge mechanisms found in conventional door and window assemblies in order to allow the thermally-broken door 1 and the window assembly 20 to pivot about the thermally-broken jamb 10 and the inner panel 4, respectively. In addition to hinges, the present invention additionally includes a door knob assembly that enables the thermally-broken door 1 to be opened and closed. Similarly, the present invention may additionally include a handle or similar device for aiding in opening and closing the window assembly 20. The present invention may include latches or similar means of keeping the window assembly 20 closed within the window opening 25.

Figure 10:
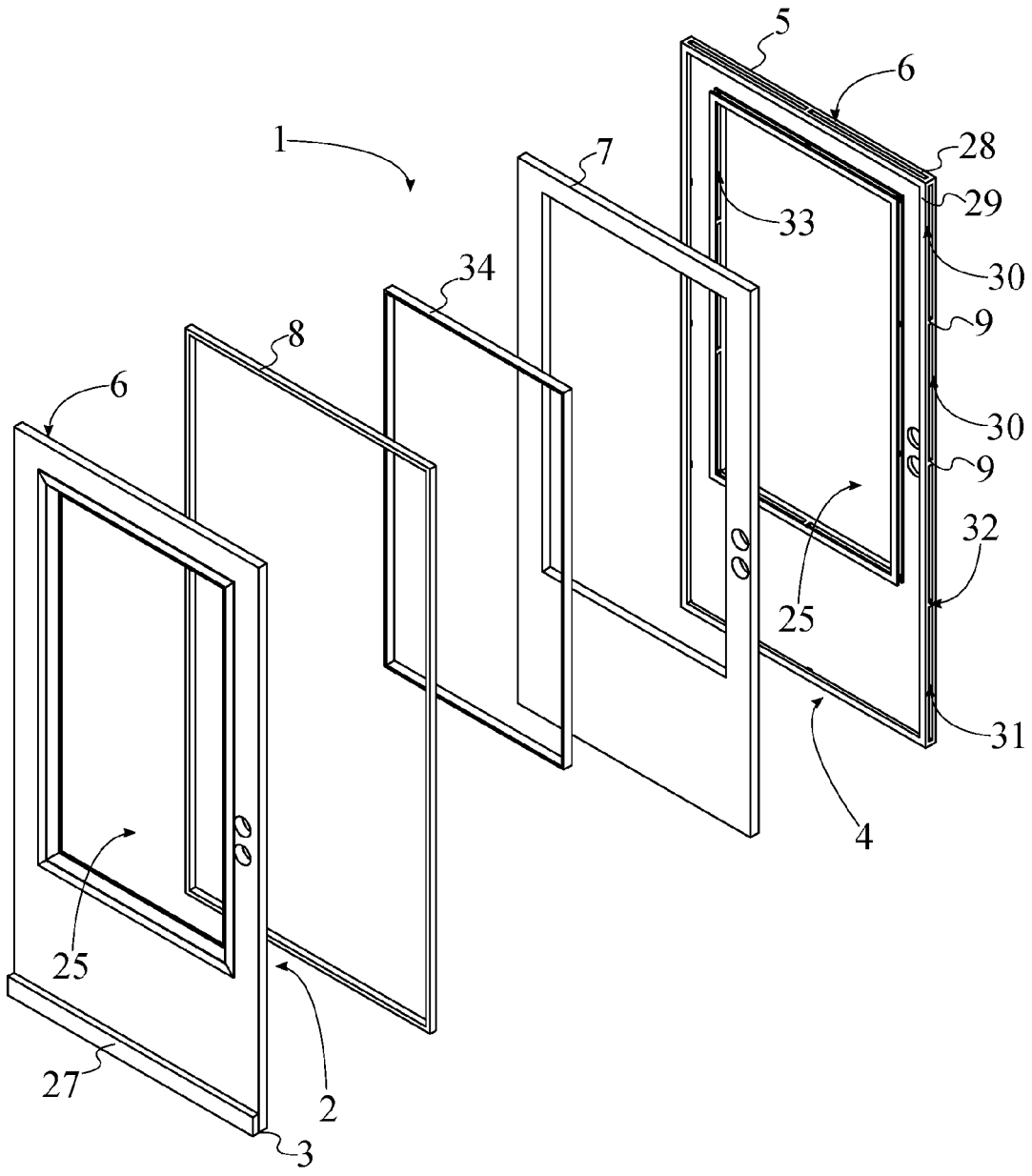
FIG. 10 is a front exploded perspective view of an alternative embodiment of the thermally-broken door with the first channel frame and the second channel frame.
Figure 11:
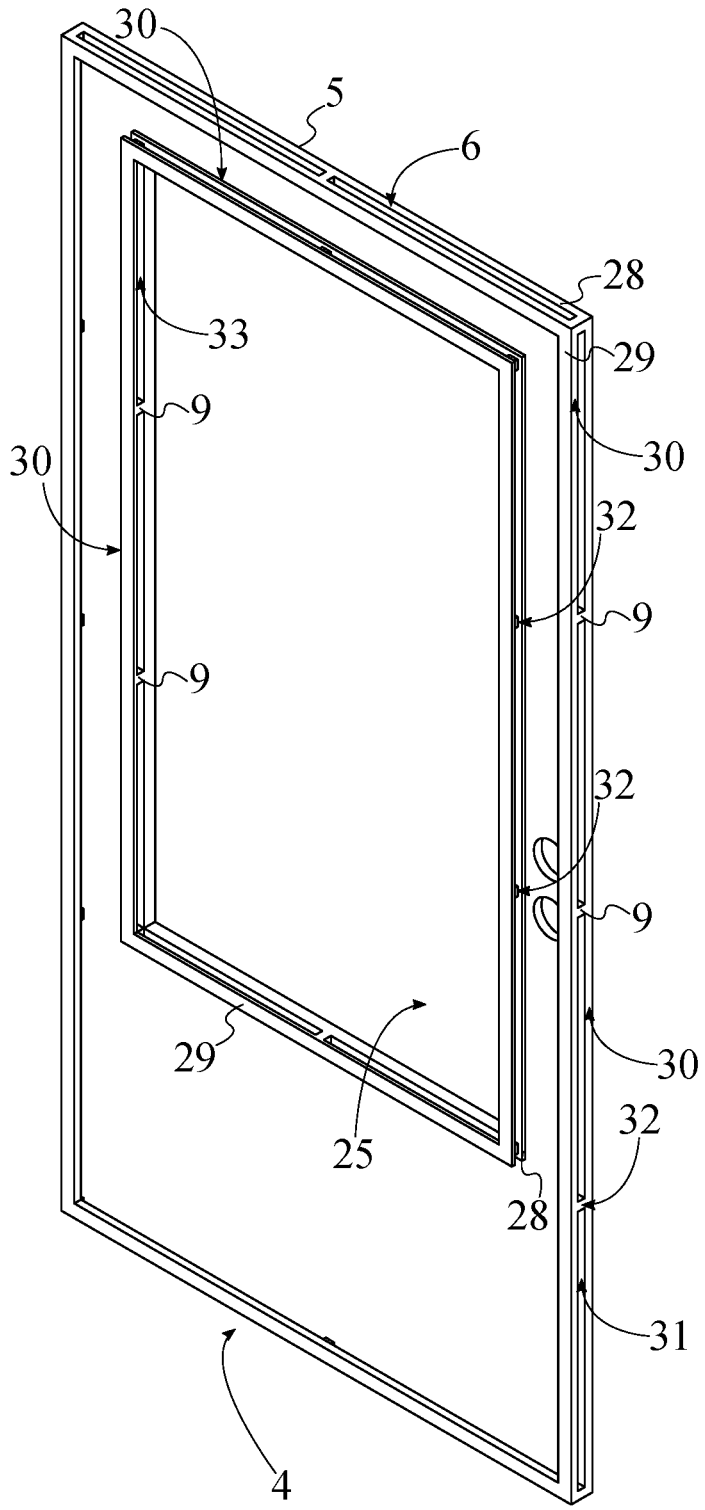
FIG. 11 is a front perspective view of an alternative embodiment of the inner panel with the first channel frame and the second channel frame.

The embodiment of the present invention shown in FIG. 10 and FIG. 11 further comprises a first channel frame 28 and a second channel frame 29. The first channel frame 28 and the second channel frame 29 are positioned about the panel outer edge 5 and are utilized along with the plurality of door bridging strips 9 to connect the inner panel 4 to the outer panel 2. The first channel frame 28 and the second channel frame 29 are preferably composed of the same material as that of the plurality of door bridging strips 9. The first channel frame 28 and the second channel frame 29 are positioned about the panel outer edge 5, similar to the plurality of door bridging strips 9 for connection to the outer panel 2. The first channel frame 28 and the second channel frame 29 thus encompass the entire outer perimeter of the inner panel 4. The plurality of door bridging strips 9 is positioned in between the first channel frame 28 and the second channel frame 29. As a result, the plurality of door bridging strips 9 serves to connect the first channel frame 28 to the second channel frame 29. A door bridging channel 31 is delineated by an outer lateral surface 32 of each of the plurality of door bridging strips 9 and a frame outer edge 30 of the first channel frame 28 and the second channel frame 29. The door bridging channel 31 is a gap between the first channel frame 28 and the second channel frame 29 that serves to minimally connect the first channel frame 28 and the second channel frame 29 through the plurality of door bridging strips 9.

With continued reference to FIG. 10 and FIG. 11, the first channel frame 28 and the second channel frame 29 are positioned about the window opening 25. In this case, the first channel frame 28 and the second channel frame 29 further serve to connect the inner panel 4 to the outer panel 2. The plurality of door bridging strips 9 is positioned in between the first channel frame 28 and the second channel frame 29 in order to connect the first channel frame 28 to the second channel frame 29. A window bridging channel 33 is delineated by an outer lateral surface 32 of each of the plurality of door bridging strips 9 and a frame outer edge 30 of the first channel frame 28 and the second channel frame 29. The window bridging channel 33 is a gap between the first channel frame 28 and the second channel frame 29 that serves to minimally connect the first channel frame 28 and the second channel frame 29 through the plurality of door bridging strips 9.

Although the present invention has been explained in relation to its preferred embodiment, it is understood that many other possible modifications and variations can be made without departing from the spirit and scope of the present invention as hereinafter claimed.

What is claimed is:

1. A thermally-broken ornamental door assembly comprises:

a thermally-broken door;

a thermally-broken jamb;

the thermally-broken door comprises an outer panel, an inner panel, an insulating foam panel, a door thermal break seal, and a plurality of door bridging strips;

the thermally-broken door being pivotally mounted into the thermally-broken jamb;

the plurality of door bridging strips being perimetrically distributed around a panel outer edge of the inner panel;

the outer panel being mounted adjacent to the inner panel by the plurality of door bridging strips;

the insulating foam panel being positioned in between the outer panel and the inner panel;

the door thermal break seal being hermetically connected in between the outer panel and the inner panel;

the door thermal break seal being positioned about the insulating foam panel;

a first channel frame;

a second channel frame;

the first channel frame and the second channel frame being positioned about the panel outer edge;

the plurality of door bridging strips comprising a plurality of first door bridging strips;

the plurality of first door bridging strips being positioned in between the first channel frame and the second channel frame; and a door bridging channel being delineated by an outer lateral surface of each of the plurality of first door bridging strips and a frame outer edge of the first channel frame and the second channel frame.

2. The thermally-broken ornamental door assembly as claimed in claim 1 further comprises:

the door thermal break seal traversing along the plurality of door bridging strips from an outer lateral surface of the inner panel to an outer lateral surface of the outer panel.

3. The thermally-broken ornamental door assembly as claimed in claim 1 further comprises:

the thermally-broken jamb comprises an outer jamb frame, an inner jamb frame, an insulating foam core, a jamb thermal break seal, and a plurality of jamb bridging strips;

the plurality of jamb bridging strips being perimetrically distributed around a frame outer edge of the inner jamb frame;

the outer jamb frame being mounted adjacent to the inner jamb frame by the plurality of jamb bridging strips;

the insulating foam core being positioned in between the outer jamb frame and the inner jamb frame;

the jamb thermal break seal being hermetically connected in between the outer jamb frame and the inner jamb frame; and the jamb thermal break seal being positioned about the insulating foam core.

4. The thermally-broken ornamental door assembly as claimed in claim 1 further comprises:

a window assembly;

a window opening;

the window opening traversing normally through the outer panel, the inner panel, and the insulating foam panel;

the window assembly being positioned within the window opening; and the window assembly being pivotally mounted to the inner panel.

5. The thermally-broken ornamental door assembly as claimed in claim 4 further comprises:

a window opening thermal break seal;

the window assembly comprises a glass panel, a retaining spacer frame, an inner window frame, and a window weather seal;

the window weather seal being perimetrically connected around the glass panel;

the retaining spacer frame being perimetrically connected around the window weather seal;

the retaining spacer frame being hermetically pressed against the window weather seal;

the window weather seal being hermetically pressed against the glass panel;

the inner window frame being hermetically pressed against the window weather seal;

the inner window frame being hermetically pressed against the retaining spacer frame;

the window opening thermal break seal being hermetically connected in between the outer panel and the inner panel;

the window opening thermal break seal being positioned about the window opening.

6. The thermally-broken ornamental door assembly as claimed in claim 1 further comprises:

a thermally-insulative threshold;

the thermally-broken jamb comprises an outer jamb frame;

the outer jamb frame comprises a first elongated member, a second elongated member, and a cross member;

the first elongated member and the second elongated member being oriented parallel to each other;

the cross member being connected across the first elongated member and the second elongated member;

the thermally-insulative threshold being connected across the first elongated member and the second elongated member; and the cross member and the thermally-insulative threshold being positioned opposite to each other along the first elongated member and the second elongated member.

7. The thermally-broken ornamental door assembly as claimed in claim 6 further comprises:

a door sweep; and the door sweep being connected along a base edge of the outer panel.

8. The thermally-broken ornamental door assembly as claimed in claim 7 further comprises:

wherein the thermally-broken door and the thermally-broken jamb are in a closed configuration; and the door sweep being positioned adjacent to the thermally-insulative threshold.

9. The thermally-broken ornamental door assembly as claimed in claim 1 further comprises:

a third channel frame;

a fourth channel frame;

a window opening;

the window opening traversing normally through the inner panel;

the third channel frame and the fourth channel frame being positioned about the window opening;

the plurality of door bridging strips comprising a plurality of second door bridging strips;

the plurality of second door bridging strips being positioned in between the third channel frame and the fourth channel frame; and a window bridging channel being delineated by an outer lateral surface of each of the plurality of second door bridging strips and a frame outer edge of the third channel frame and the fourth channel frame.

* * * * *